US006321828B1

(12) United States Patent
Pleschiutschnigg

(10) Patent No.: US 6,321,828 B1
(45) **Date of Patent: *Nov. 27, 2001**

(54) CONTINUOUS CASTING FACILITY AND PROCESS FOR PRODUCING RECTANGULAR THIN SLABS

(75) Inventor: Fritz-Peter Pleschiutschnigg, Duisburg (DE)

(73) Assignee: Mannesmann Aktiengesellschaft, Düsseldorf (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/157,477

(22) Filed: Sep. 21, 1998

Related U.S. Application Data

(63) Continuation-in-part of application No. 08/682,670, filed on Jul. 29, 1996, now abandoned.

(30) Foreign Application Priority Data

Jan. 28, 1994 (DE) ..... 44 03 048

(51) Int. Cl.[7] ..... B21D 11/07
(52) U.S. Cl. ..... 164/472; 164/488; 164/268
(58) Field of Search ..... 164/472, 268, 164/437, 488

(56) References Cited

U.S. PATENT DOCUMENTS 3,318,363 * 5/1967 Goss ..... 164/472

FOREIGN PATENT DOCUMENTS 60-87959 * 5/1985 (JP) ..... 164/268

OTHER PUBLICATIONS

"Giessen und Giesswalzen dunner Brammen bei der Mannesmannrohren–Werke AG" by Ehrenberg et al, Dusseldorf, DE, No. 9/10, May 16, 1989, pp. 453–462, by Stahl et al.*

* cited by examiner

*Primary Examiner*—Tom Dunn
*Assistant Examiner*—Jonathan Johnson
(74) *Attorney, Agent, or Firm*—Cohen, Pontani, Lieberman & Pavane

(57) ABSTRACT

A process and a continuous casting installation for the production of thin slabs, preferably of steel with a predetermined solidification thickness of, e.g., 50 mm, in which an optimum surface quality and internal quality of the strand with minimal and predetermined solidification thickness and plant capacity, and accordingly minimal rolling effort, is achieved by a qualitative adjustment of casting and rolling in the region of the strand guide, oscillation of the casting mold by a hydraulically operated lifting platform, feeding of casting powder to the mold, and an immersion nozzle with a specific cross sectional area of flow relating to the process and continuous casting installation, resulting in a satisfactory supply of casting slag and bath movement in the cast surface compared with a standard slab with a thickness of 200 mm. These conditions from the crater end to the cast surface exert a direct influence on the superficial and internal quality of the strand and on the reliability of the casting process.

4 Claims, 7 Drawing Sheets

CONTINUOUS CASTING FACILITY AND PROCESS FOR PRODUCING RECTANGULAR THIN SLABS

This application is a Continuation-in-Part of U.S. patent application Ser. No. 08/682,670 filed Jul. 29, 1996, now abandoned. The disclosure of U.S. patent application Ser. No. 08/682,670 is expressly incorporated herein by reference.

BACKGROUND OF THE INVENTION

1. Field of the Invention

The invention is directed to a continuous casting installation and to a process for the production of thin slabs.

2. Description of the Related Art

The use of flat immersion nozzles in continuous casting installations is known, for example, from the prior art reference DE 37 09 188 A1. Further, hydraulically driven lifting platforms which allow the stroke, frequency and mode of the oscillation to be changed and optimally selected by deviating from the sinusoidal oscillation during the casting process itself are conventional. Continuous casting and rolling in which the thickness of the cast metal is reduced during solidification so that the internal quality of the strand is improved is known, for example, from reference DE 38 18 077 A1, among other references.

Evaluation of the prior art reveals that the aim of producing thin strands using continuous casting installation requires the solution of complex problems. The totality of influenceable variables with respect to the entire continuous casting installation is so great that the person of average skill in the art is far from knowledgeable enough, and can also not be expected, to find, from the multitude of more or less usable possible solutions, one solution which will lead to satisfactory results in the most economical manner.

SUMMARY OF THE INVENTION

The object of the present invention is to provide a process and a continuous casting installation which make it possible to achieve a given thickness of the thin strand by achieving optimum conditions in the slag supply and in the reduction in strand thickness in the mold and in the guide stand during continuous casting and rolling.

The object of the present invention is met by a process for producing thin slabs or strands by casting molten in an oscillating rectangular mold using an immersion nozzle, where the immersion nozzle and mold are sized to meet the condition so that $$\frac{F_{ST}}{F_{TA}} > 50,$$

where $F_{ST}$=the strand cross sectional area of a completely solidified slab and $F_{TA}$=the cross sectional area of an outlet of the immersion nozzle. The process also includes supplying casting powder to the molten metal such that the height of a slag phase $h_{slag}$ at the upper part of the mold is greater than or equal to the height of a portion of a solid strand shell $h_{strand\text{-}shell}$ which penetrates into the slag phase layer at the upper portion of the mold. In other words, the casting powder is supplied such that the solidified strand shell does not penetrate through the upper surface of the slag phase layer at the upper part of the mold. The oscillation stroke, shape, and frequency of the oscillating movement affect how far the solidified strand shell penetrates the upper surface of the slag phase layer and determine the rate of production of the strand. Accordingly, the rate at which the casting powder is supplied during to achieve the above results is dependent upon the oscillation stroke, shape and frequency of the oscillating movement of the mold because these parameters determine the rate at which the strand is produced. A faster production of strand requires a faster rate of supplying of casting powder. The strand which leaves the mold is then reduced directly below the mold in a plurality of steps in a cluster roll stand so that the strand achieves its final thickness while still having a liquid core at the end of the cluster roll stand. The solidification is controlled so that a two-phase zone is present within the strand after achieving the final thickness at the output of the cluster roll stand.

In another embodiment, both the oscillation characteristics of the mold and the supply of casting powder are selected during casting.

The object of the present invention is also met by a continuous casting installation including an oscillating rectangular mold and means for oscillating the mold, the means for oscillating the mold being adjustable relative to frequency, stroke and mode of oscillation. The invention casting installation also includes an immersion nozzle arranged to project into the rectangular mold having a cross sectional area that is less than 1/50 of the cross sectional area of the completely solidified slab or strand. The casting installation further includes means for supplying casting powder to the mold as a function of the stroke, mode, and frequency of oscillation of the oscillating mold such that the height of the slag phase layer formed at the upper end of the mold is greater than the height of the strand shell which penetrates the slag phase layer. A cluster roll arranged downstream of the mold and includes two rolls that are adjustably arranged at a distance from one another. The cluster roll further includes a hydraulic arrangement operatively arranged for continuously adjusting the distance between the two rolls.

In a further embodiment, the two rolls are arranged to have a distance therebetween for reducing the strand thickness as the strand is fed through the rolls. The reduction in thickness reduces the area of the of the liquid interior and therefore creates a flow of the remaining liquid. The flow results in a stirring effect in the remaining liquid interior of the strand with a predetermined strand thickness reduction.

The solution to the problem is not dependent upon the type of mold, e.g., vertical mold, vertical mold with bend, or curved mold.

The invention is described hereinafter by way of example with reference to the drawings.

DETAILED DESCRIPTION OF THE PRESENTLY PREFERRED EMBODIMENTS

Results of tests carried out in researching the invention show that the surface quality of a strand substantially depends upon the management of slag. More particularly, the tests revealed that the interplay between the slag height of the layer of slag at the upper part of a mold ($h_{slag}$) and the strand shell height ($h_{strand\ shell}$) emerging from the bath into that layer of slag during the upstroke of the mold is at least partially responsible for the surface quality of a strand.

The present invention relates to the production of thin slabs having a length and an approximately rectangular cross section. The approximately rectangular cross section of the thin slabs has a thickness which is the smaller of the two dimensions and a width which is the longer of the two dimensions. Since the present invention relates to thin slabs, the thickness is typically much smaller than the width and is not greater than one fifth of the width.

Figure 1:
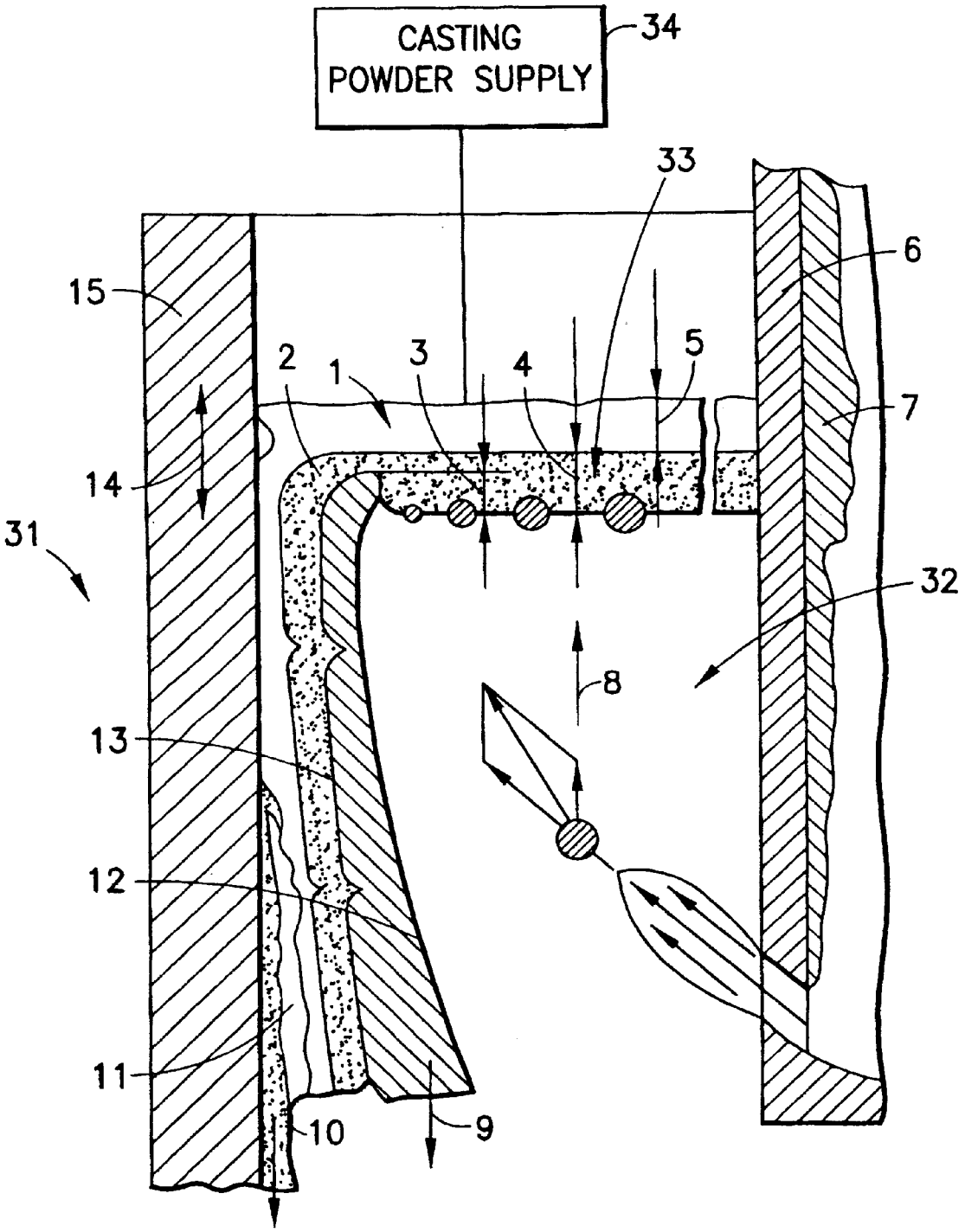
FIG. 1 is a cross sectional view showing casting conditions in a mold according to an embodiment of the present invention.

Referring to FIG. 1, an immersion nozzle 6 is arranged in a mold 31 for supplying a deposit 7 to a bath 32 in the mold 31 for making a strand A copper plate 15 of the mold 31 is oscillated in the direction indicated by arrow 14. casting of the strand is carried out in the direction indicated by arrow 9. During casting, a strand shell 13 is formed in the bath 32 along the copper plate 15 with a crystallization boundary 12 between the solid steel of the strand shell 13 and the liquid steel of the bath 32, which forms a liquid core of the strand. In addition, a slag phase layer 33 forms on the top of the bath 32 having a slag height ($h_{slag}$) 4. The slag phase is also present between the strand shell 13 and the copper plate 15 on the external surface of the strand shell 13. An air gap 11 is generated toward the bottom of the mold 31 between the slag on the outer surface of strand shell 13 and a slag region 10 on the copper plate. In addition, casting powder 1 is introduced into the mold 13 via a casting powder feed supply 34 creating a powder/slag boundary 2. The casting powder 1 has a height 5. FIG. 1 further shows the direction 8 of oxide flow toward the slag layer 33.

As the deposit 7 comprising liquid or molten steel is supplied to the mold 13 and the strand shell 13 hardens, the copper plate or plates 15 of mold 31 are oscillated by moving in a substantially vertical plane. This oscillatory motion leads to a relative movement between the formed strand shell 13 and the copper plate 15 or mold wall of the mold 31. During the 5 oscillatory movement, the strand shell 13 slowly moves toward the bottom of the mold so that for each cycle of oscillation, the strand shell 13 remains in a quasi-stationary state. Therefore, the strand shell 13 at times is nearer the upper opening of the mold 31 and at times is nearer the lower opening of the mold 31.

The tests performed during research for the invention revealed that amount of travel of the mold 31 during the oscillations is in practice so large, that as the slag layer 33 moves with the mold 31, the strand shell 13 breaks through the slag layer 33 at the upper part of the mold 31. The testing further revealed that this causes flaws in the outer surface of the strand because the penetration of the strand shell 13 through the slag layer 33 prevents the slag which acts as a lubricant, from flowing to the external surface of the strand shell 13. Without 45 the slag acting as a lubricant between the strand shell 13 and copperplate 15 of the mold 31, the outer surface of the strand shell 13 is directly exposed to the oscillating copper plate 15 of the mold 31.

Accordingly, the tests have shown that the following criterion $$h_{slag} \geqq h_{strand\ shell} \tag{1}$$

must be met for optimum lubrication and to prevent surface defects (casting powder particles, predominantly in the form of oxides, located directly below the strand surface).

The slag height $h_{slag}$ 4 depends primarily on the thickness of the mold inlet cross sectional area and the amount of casting powder input of the mold during casting. The strand shell height $h_{strand\ shell}$ 3 depends primarily on the stroke of the length oscillating mold.

When considering the value $h_{slag}$ and its dependence on the thickness of the mold inlet cross section, the following equation may be used to determine the technical effort which $$\text{handicap} = \frac{\text{external surface area of a strand produced per minute } (m^2/min)}{\text{bath surface area } (m^2)} \text{ in } m^2/min \times l/m^2 \tag{2}$$

must be put into the system to attain the desired characteristics in the outer surface of the strand shell 13.

Figure 2:
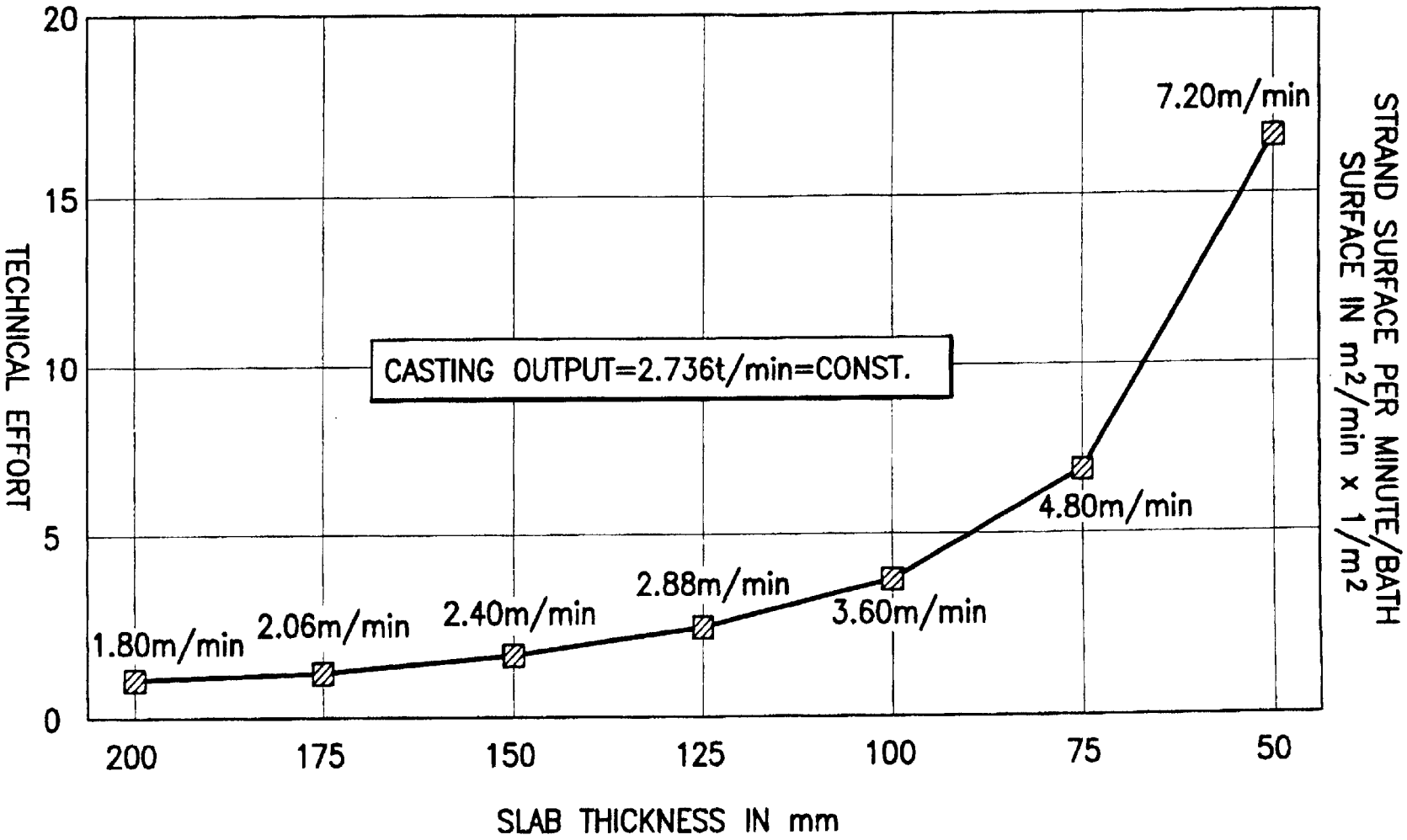
FIG. 2 in a graph depicting the technical effort required to achieve uniform surface quality and casting output as a function of the slab thickness with reference to a slab with a thickness of 200 mm and a width of 1,000 mm.

The technical effort is a measure of the outlay for and complexity of the equipment required for maintaining relationship (1) for preventing flaws in the outer surface of the strand shell 13. Referring to FIG. 2, the relationship (2) was solved using a 200 mm thick slab as a reference point. The reference point of the 200 mm thick slab is given the technical effort value of 1. As the slab thickness is reduced to 50, and the width of the slab and the casting output of 2.736 t/min is maintained the external area of strand produced per minute increases by 4 and the bath surface decreases by ¼. Therefore, according to equation (2), the technical effort rises to approximately 16. The relationship according to the graph in FIG. 2 shows that the technical effort is inversely proportional to slab thickness and follows an exponential curve. The measured relationship agrees with practice because to meet the same casting output in t/min, the strand having a smaller thickness must move much faster; making the relationship (1) between the slag and strand shell more difficult to maintain.

Figure 3A:
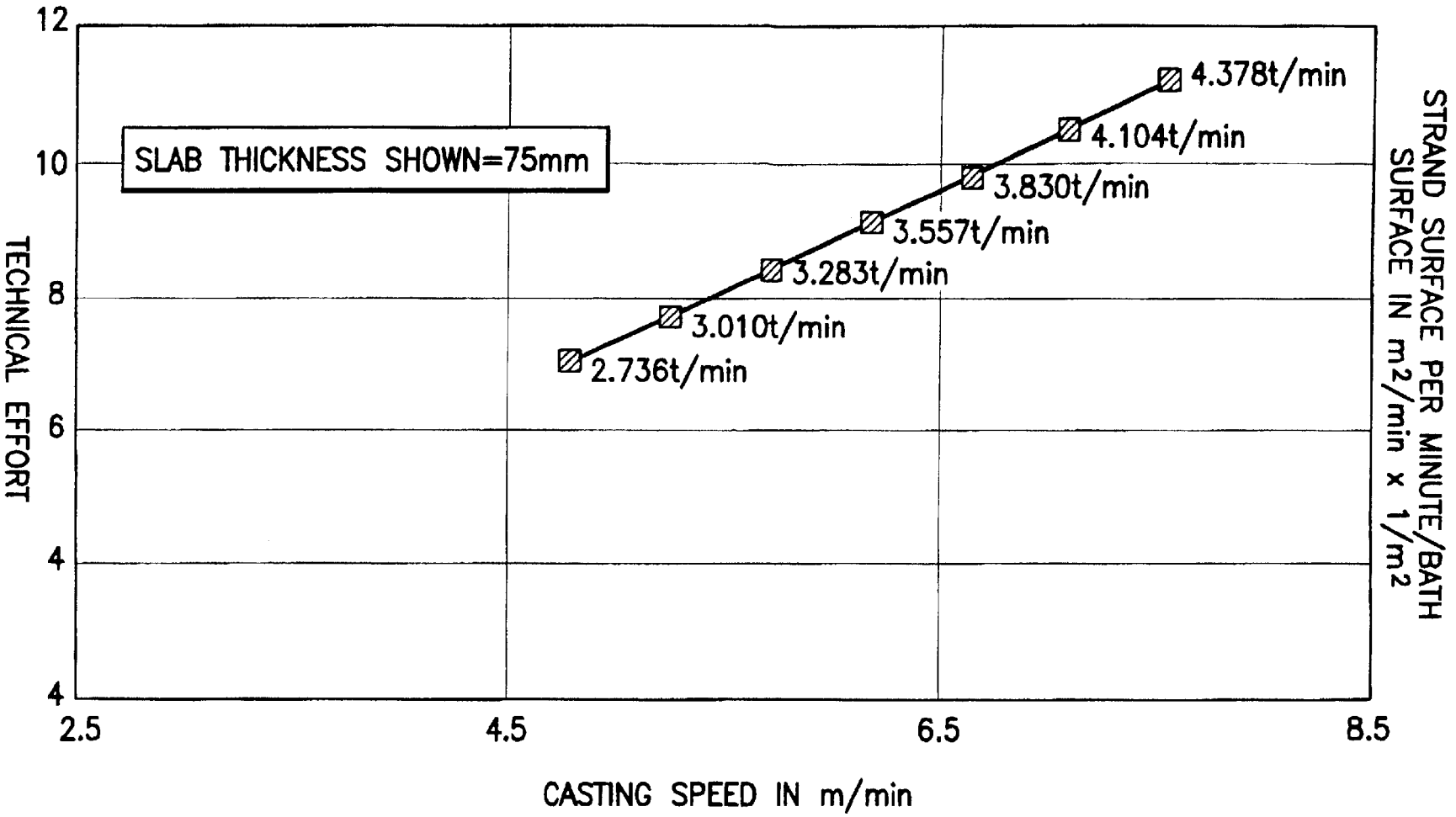
FIGS. 3A–3CD are graphs depicting the technical effort required to achieve uniform surface quality and slab thickness as a function of the casting speed with reference to a slab with a thickness of 200 mm and a width of 1,000 mm.
Figure 3B:
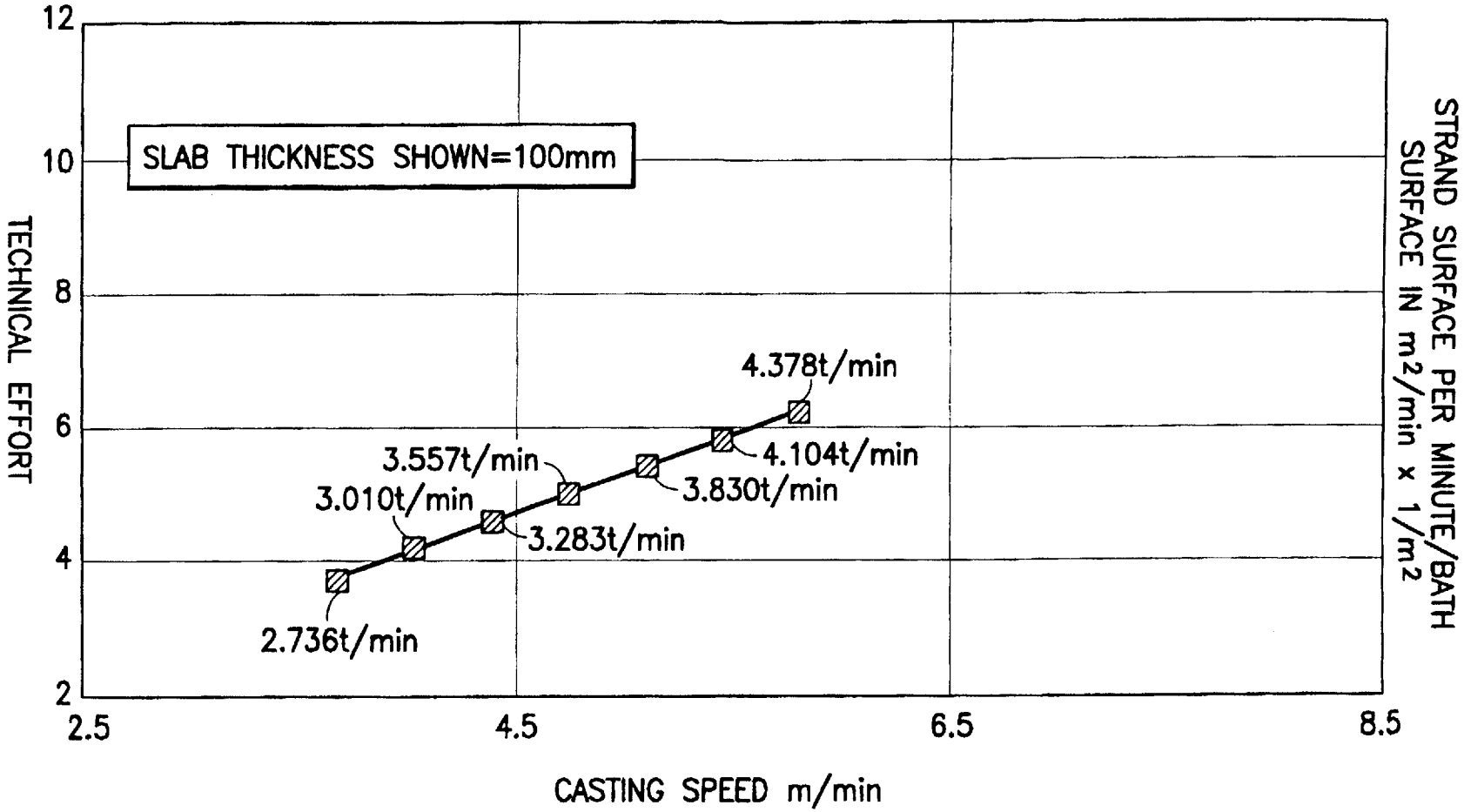
Figure 3C:
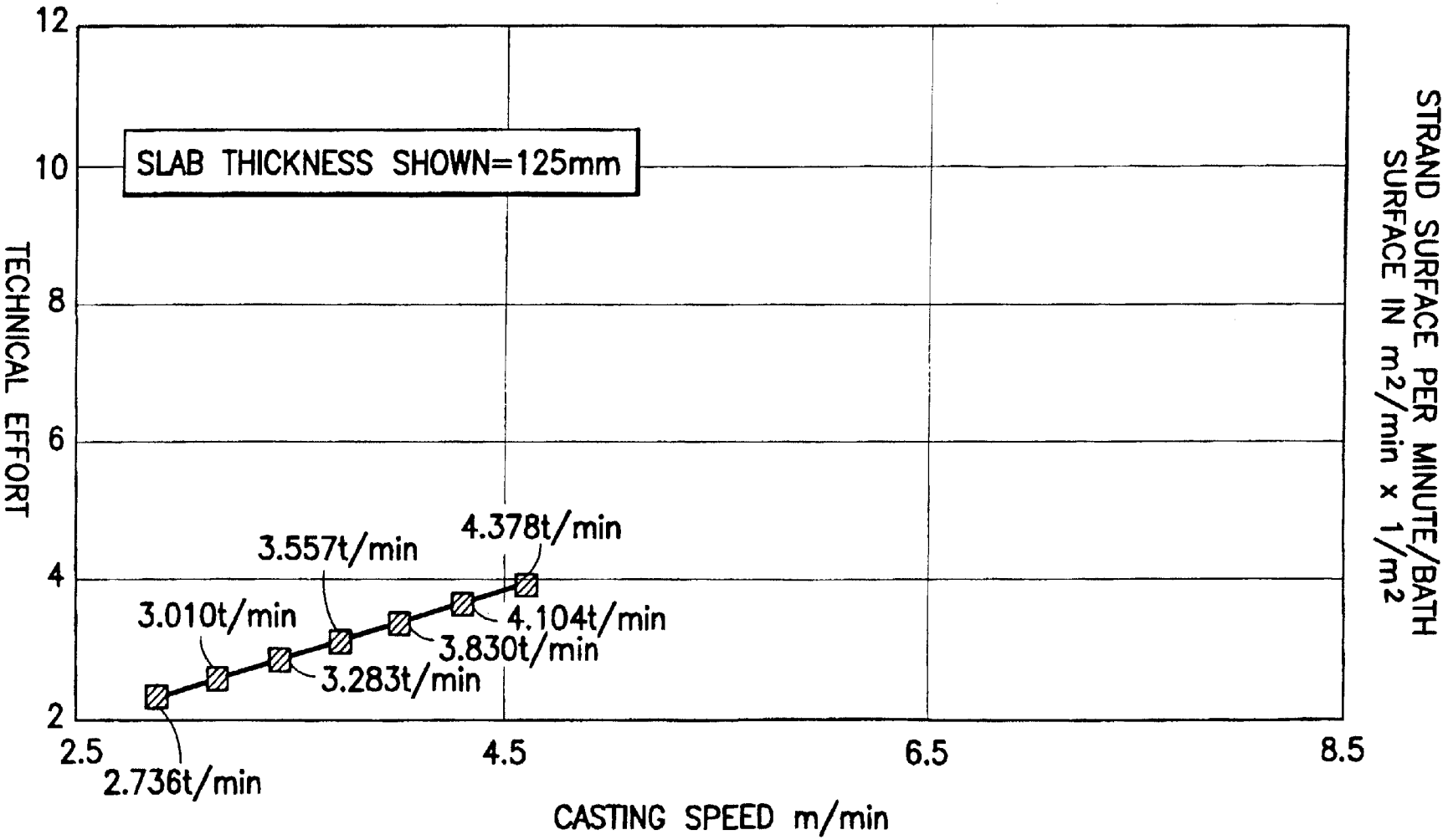

FIGS. 3A, 3B and 3C show how a change in casting speed with a respective constant casting thickness of 75 mm, 100 mm, 125 mm affects the technical effort value of equation (2). These graphs show that the technical effort values increase linearly with the casting speed when the thickness of the resulting strand is maintained.

Relationship (1) is also influenced considerably by the turbulence which occurs when the metal flows into the mold and which often extends to the bath surface and can lead to wave movements. The crests of the waves can rise above the slag layer 33 resulting in interrupted lubrication. This turbulence is dependent in part on the throughput and on the thickness and width of the mold at the immersion nozzle outlet cross section. In order to measure the turbulence, the hydraulic behavior is defined as the quotient of throughput and thickness and can be expressed as follows:

$$\text{hydraulic behavior} = \frac{\text{throughput in } t/min}{\text{thickness in mm}} \tag{3}$$

Figure 4:
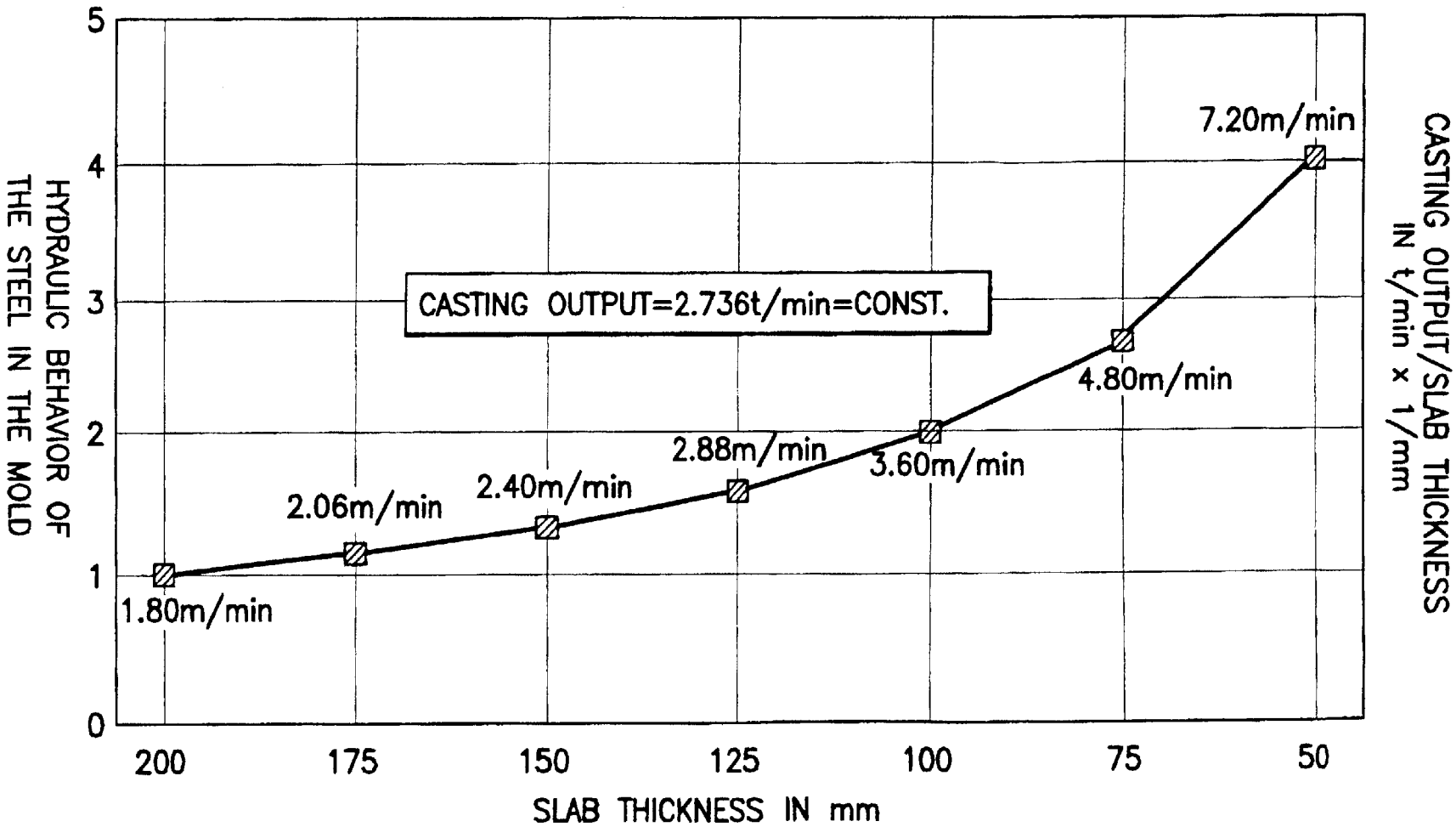
FIG. 4 is a graph depicting the hydraulic behavior of the steel in the mold as a function of the slab thickness with reference to a slab with a thickness of 200 mm and a width of 1,000 mm.

Values for the hydraulic behavior with reference to the 200-mm thick slab are shown by way of example in FIG. 4. It will be seen that larger mold thicknesses result in an appreciable improvement in hydraulic behavior. The results of relationship (3) make sense from a practical standpoint because, given the same throughout, a larger mold will receive a deposit with less disturbance than a smaller mold which receives the same deposit.

Testing has also revealed that the following relationship is also significant with regard to turbulence:

$$\frac{F_{ST}}{F_{TA}} > 50, \tag{4}$$

where $F_{TA}$=cross-sectional surface of the immersion nozzle outlet, and $F_{ST}$=strand cross sectional area of a completely solidified slab at the output end of the mold.

Further, an electromagnetic brake in the mold region can noticeably reduce the turbulence in the region of the cast surface.

It follows from the relationships given above, which were verified by measurements, that reducing the slab thickness in the mold, for example, from 100 mm to 50 mm, increases the problems in maintaining relationship (1) to an extraordinary extent. That is, leaving aside the difficulties in the metal feed, it is virtually impossible to apply sufficient casting powder to produce a slag layer on the small mold inlet cross sectional area to sufficiently lubricate the resulting enormous strand surface and, moreover, to adjust relationship (4). On the other hand, the casting speed can be increased without special additional effort with a strand thickness of, e.g., 75 mm in the mold and accordingly in the cast surface. Surprisingly, it has been found that it is not necessary to maintain a constant slab thickness of the mold until the end of the solidification (crater end) in the area of thin-slab casting, but rather that it is considerably simpler in terms of technical effort to reduce and achieve the slab thickness as it is fed to the rolling mill by means of a continuous casting and rolling step. A cluster roll stand, e.g., constructed as a gripper segment, has proven advantageous for this purpose.

Figure 5:
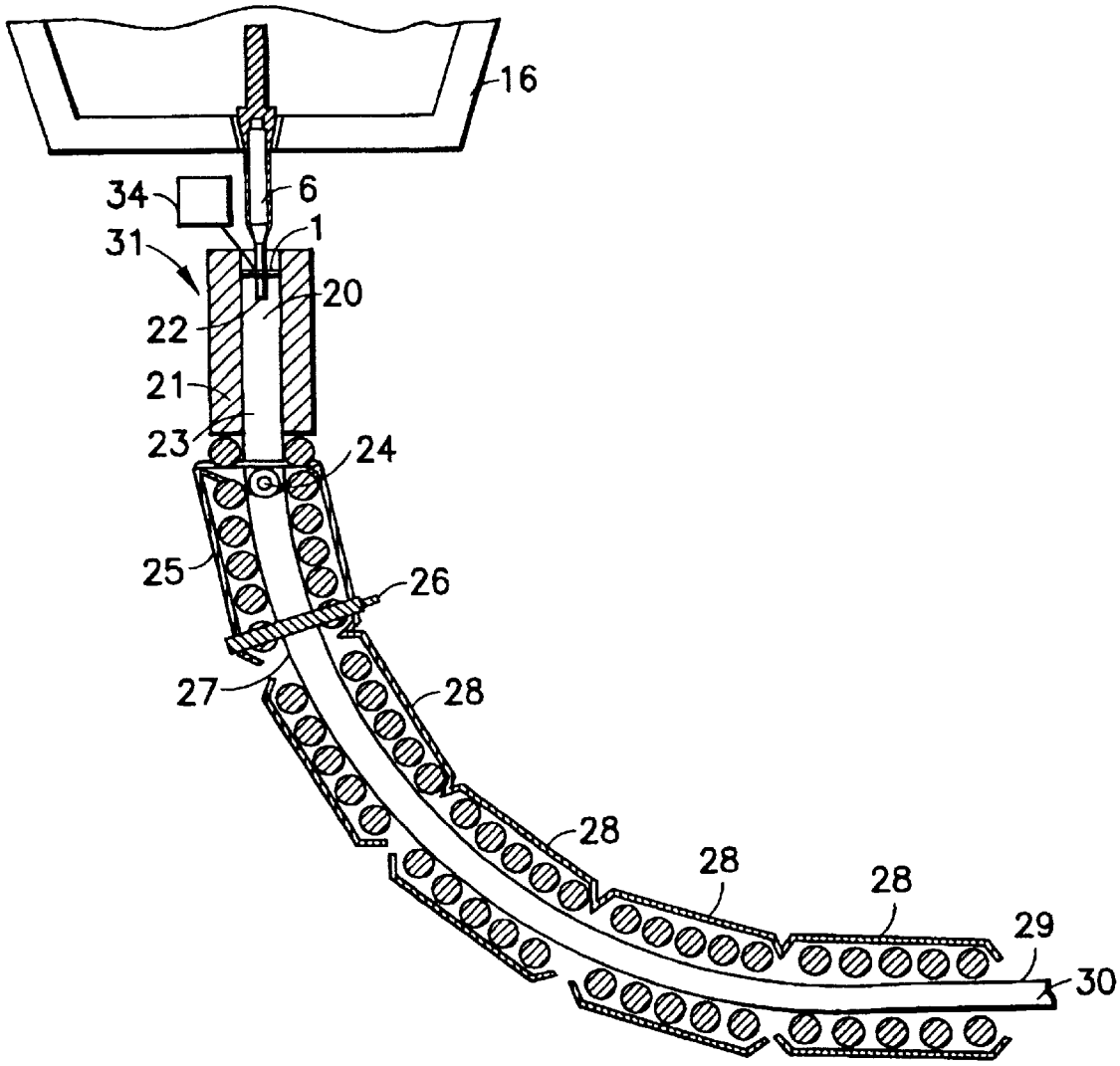
FIG. 5 shows a continuous casting installation according to an embodiment of the present invention.

FIG. 5 shows a continuous casting installation, by way of example, which contains all of the inventive features. The immersion nozzle 6, which has outer dimensions such, for example, as 250×45 mm and inner dimensions with a cross section 20 of, for example, 220×15 mm projects from a spreader 16 into the mold 31. A hydraulic mold drive 21 oscillates the mold 31 while the casting powder supply 8 introduces casting powder 1 therein. A slab 23 is produced by the mold 31 and is engagedly received by a gripper segment 25 having hydraulic cylinders 24, 26. The slab 27 leaving the gripper segment has a thickness of 50 mm. The slab may pass through a number of additional segments 28 and exits at a strand exit 30 with a slab thickness of 50 mm and a speed of 6 m/min. As mentioned above, the casting speed and reduction of the strand are designed so that the strand exiting at the strand exit 30 has a remaining liquid core. The process is also controlled so that a two-phase zone is present within the strand after achieving the final thickness at strand exit 30.

I claim:

1. A process for continuously casting thin slabs, comprising the steps of:

casting molten metal in an oscillating rectangular mold using an immersion nozzle while maintaining conditions for the immersion nozzle and the mold so that:

$$\frac{F_{ST}}{F_{TA}} > 50,$$

where $F_{ST}$=a cross sectional area of a completely solidified slab, and $F_{TA}$=a cross sectional area of an outlet of the immersion nozzle;

supplying casting powder to the molten metal so that a relationship $$h_{slag} \geqq h_{strand\ shell},$$

where $h_{slag}$=a height of a layer of slag proximate an upper surface of the mold, and $h_{strand\ shell}$=a height of a portion of a strand shell in the mold which penetrates the layer of slag proximate the upper surface of the mold, is maintained depending on the oscillating stroke, shape and frequency of mold movement;

reducing the strand cross section directly below the mold in a plurality of steps in a cluster roll stand to form a forced convection in a remaining liquid interior of the strand parallel to a continuous strand thickness reduction, so that the strand achieves its final thickness while still having a liquid core at the end of the cluster roll stand; and controlling solidification so that a two-phase zone is present within the strand after achieving the final thickness at an output of the cluster roll stand.

2. The process of claim 1, including the step of selecting the frequency, stroke, and oscillation mode for the mold movement during casting to achieve a desired output and so that the relationship $h_{slag}>h_{strand\ shell}$ is maintained.

3. A continuous casting installation for producing thin slabs, comprising:

an oscillating rectangular mold;

means for oscillating the mold, the oscillating means being adjustable relative to frequency, stroke and mode of oscillation;

an immersion nozzle having a cross sectional area that is less than 1/50 of a strand cross sectional area at the outlet of the mold, the immersion nozzle being arranged to project into the rectangular mold;

casting powder feed means for supplying powder to the mold as a function of the stroke, mode and frequency of oscillation of the mold so that a height of a slag layer proximate the upper surface of said mold is greater than or equal to a height of portion of a strand shell which penetrates the slag layer; and a cluster roll stand arranged downstream of the rectangular mold and including two rolls adustably arranged at a distance from and opposite one another, and a hydraulic arrangement operatively arranged to change the distance between the two rolls in a continuous manner.

4. A continuous casting installation according to claim 3, wherein two rolls are arranged to have a distance therebetween so that a stirring effect results in a remaining liquid interior of the strand with predetermined strand thickness reduction.

* * * * *